US008894562B2

(12) United States Patent
Zahnert et al.

(10) Patent No.: US 8,894,562 B2
(45) Date of Patent: Nov. 25, 2014

(54) IMPLANTABLE MICROPHONE FOR HEARING SYSTEMS

(75) Inventors: Thomas Zahnert, Dresden (DE); Gert Hofmann, Lange Grück (DE); Matthias Bornitz, Dresden (DE); Hannes Seidler, Dresden (DE); Karl-Bernd Hüttenbrink, Dresden (DE); Alexander Hellmuth, Innsbruck (AT)

(73) Assignee: MED-EL Elektromedizinische Geraete GmbH, Innsbruck (AT)

( * ) Notice: Subject to any disclaimer, the term of this patent is extended or adjusted under 35 U.S.C. 154(b) by 586 days.

(21) Appl. No.: 12/953,397

(22) Filed: Nov. 23, 2010

(65) Prior Publication Data

US 2011/0137109 A1 Jun. 9, 2011

Related U.S. Application Data

(60) Provisional application No. 61/264,139, filed on Nov. 24, 2009.

(51) Int. Cl.
*H04R 25/02* (2006.01)
*H04R 25/00* (2006.01)

(52) U.S. Cl.
CPC ..... *H04R 25/606* (2013.01)
USPC ..... 600/25

(58) Field of Classification Search
CPC .... H04R 25/60; H04R 25/604; H04R 25/606; H04R 25/608; H04R 25/67
USPC ..... 600/25; 381/114, 23.1, 312–331; 181/128–135; 623/10; 607/136–137
See application file for complete search history.

(56) References Cited

U.S. PATENT DOCUMENTS

| | | | | |
|---|---|---|---|---|
| 2,803,129 | A * | 8/1957 | Bradfield | 73/610 |
| 6,636,768 | B1 | 10/2003 | Harrison | |
| 7,481,761 | B2 | 1/2009 | Blau et al. | |
| 7,860,259 | B2 * | 12/2010 | Onishi et al. | 381/190 |
| 2001/0003788 | A1 * | 6/2001 | Ball et al. | 600/25 |
| 2005/0020873 | A1 | 1/2005 | Berrang et al. | |
| 2005/0245990 | A1 * | 11/2005 | Roberson | 607/57 |
| 2009/0043149 | A1 * | 2/2009 | Abel | 600/25 |

FOREIGN PATENT DOCUMENTS

| | | | |
|---|---|---|---|
| EP | 1439737 | A2 | 7/2004 |
| WO | 03/081946 | A2 | 10/2003 |

OTHER PUBLICATIONS

PCT International Search Report and Written Opinion of the International Searching Authority—Application No. PCT/US2010/057851, dated Apr. 5, 2011 (10 pages).

* cited by examiner

*Primary Examiner* — Catherine B Kuhlman
(74) *Attorney, Agent, or Firm* — Sunstein Kann Murphy & Timbers LLP

(57) ABSTRACT

An implantable microphone for use in hearing systems includes a housing having a back wall. The back wall has a recess (e.g., blind hole) configured to be coupled to an auditory ossicle. The implantable microphone also includes a membrane coupled to a top portion of the housing and a vibration sensor adjacent to the membrane. The membrane is configured to move in response to movement from the auditory ossicle, and the vibration sensor is configured to measure the movement of the membrane and to convert the measurement into an electrical signal.

24 Claims, 16 Drawing Sheets

Section A-A

Section A-A

Section A-A from FIG. 22

Section A-A from FIG. 22

IMPLANTABLE MICROPHONE FOR HEARING SYSTEMS

CROSS-REFERENCE TO RELATED APPLICATIONS

This patent application claims priority to U.S. Provisional Patent Application No. 61/264,139 filed Nov. 24, 2009, entitled IMPLANTABLE MICROPHONE FOR HEARING SYSTEMS, the disclosure of which is incorporated by reference herein in its entirety.

TECHNICAL FIELD

The present invention relates to implantable microphones, and more specifically to implantable microphones with vibration sensors, also regarded as force sensor, for use with cochlear implants and other hearing systems.

BACKGROUND ART

Implantable microphones for use with cochlear implants and other hearing systems typically require an implantable converter for receiving the sound reaching the ear of the patient and converting the sound into electrical signals for further processing in the hearing system. Different solutions have been proposed in the past. In one approach, the sound waves reaching the ear are directly converted into electrical signals which can be accomplished in different ways as described, for example, in U.S. Pat. Nos. 3,882,285, 4,988,333, 5,411,467, and WO 96/21333 and EP 0 831 673. However, with this approach, the natural ability of the outer ear of directionally filtering the received sound is lost and/or the attachment of the required converter components can cause adverse reactions of the affected and surrounding tissue.

In another approach, the natural sound receiving mechanisms of the human outer and middle ear are used for converting the received sound into oscillations of the middle ear components (eardrum and ear ossicle), which are subsequently converted into electrical signals. Different converter principles have been proposed. For example, U.S. Pat. No. 3,870,832 describes implantable converters based on electromagnetic principles. However, the relatively high power consumption of such electromagnetic and electrodynamic converters limits their practical application for cochlear implants and other implantable hearing systems.

This disadvantage is obviated by converters based on piezoelectric principles. EP 0 263 254 describes an implantable converter made of a piezoelectric film, a piezoelectric crystal or a piezoelectric acceleration sensor, whereby one end of the converter is cemented in the bone while the other end is fixedly connected with an oscillating member of the middle ear. The problem with this approach is that inflexible connections to the ear ossicles can cause bone erosion, so that cementing converter components in the middle ear space is approached cautiously for mechanical and toxicological reasons. Moreover, the patent reference does not indicate how the body fluids can be permanently prevented from making contact with the piezoelectric materials. Accordingly, there is a risk of biocompatibility problems, so that the piezoelectric properties can deteriorate due to physical and chemical interactions between the piezoelectric material and the body fluids.

U.S. Pat. No. 3,712,962 describes an implantable converter that uses a piezoelectric cylinder or a piezoelectric beam as a converter component that is anchored in the ear in a manner that is not described in detail. This reference, like the aforementioned patent EP 0 263 254, does not describe in detail how body fluids can be permanently prevented from making contact with the piezoelectric materials.

WO 99/08480 describes an implantable converter based on piezoelectric principles, which is attached solely to an oscillating middle ear component, with the counter support being provided by an inertial mass connected with the converter. However, the attachment of the converter to an oscillating middle ear component, such as the ear drum or the ear ossicles, is either not permanently stable or can erode the bone. This risk is aggravated because the mass of the implantable converter is greater than that of passive middle ear implants.

WO 94/17645 describes an implantable converter based on capacitive or piezoelectric principles, that can be fabricated by micromechanical techniques. This converter is intended to operate a pressure detector in the incudo-stapedial joint. Since the stapes in conjunction with the coupled inner ear forms a resonant system, it may not have sufficient sensitivity across the entire range of useful frequencies. This problem applies also to the implantable converters described in WO 97/18689 and DE 100 30 372 that operate by way of hydroacoustic signal transmission.

U.S. Pat. No. 3,712,962 describes an implantable converter that uses a piezoelectric converter element that is housed in a hermetically sealed hollow body. The implantable converter is held in position by a support element affixed in the bone channel of the stapes tendon or extended from a screw connection with an ossicle of the middle ear space.

WO 97/11575 describes an implantable hearing aid having a piezo-based microactuator. It includes a disk-shaped transducer which is attached to an end of a tube. The tube is adapted to be screwed into a fenestration formed through the promontory.

U.S. Pat. No. 5,842,967 teaches an implantable contactless stimulation and sensing system utilizing a series of implantable magnets.

Summary of Embodiments

In accordance with one embodiment of the invention, an implantable microphone for use in hearing systems includes a housing having a back wall. The back wall has a recess configured to be coupled to an auditory ossicle. The implantable microphone also includes a membrane coupled to a top portion of the housing and a vibration sensor adjacent to the membrane. The membrane is configured to move, e.g., membrane movement may include flexural movement, in response to movement from the auditory ossicle and the vibration sensor is configured to measure the movement of the membrane and to convert the measurement into an electrical signal. The sensor element can be regarded as a force measurement cell inserted into the ossicle chain.

In accordance with related embodiments, the vibration sensor may be a piezoelectric sensor and the piezoelectric sensor may be shaped as a rectangular bar. The piezoelectric sensor includes piezoelectric material. Movement of the piezoelectric sensor causes deformation of the piezoelectric material and evokes voltage and charge transfer on at least two electrodes of the piezoelectric sensor, thus providing a voltage or charge measurement signal. The housing may have a sidewall between the top portion and the back wall and the vibration sensor may be a) coupled to the sidewall and/or b) in contact with the membrane to move in response to the membrane movement. The implantable microphone may further include one or more additional vibration sensors adjacent to the vibration sensor. The one or more additional vibration sensors may be coupled to the sidewall. The implantable microphone may further include one or more spring elements coupled to the vibration sensor and/or the one or more additional vibration sensors. The spring elements may be configured to contact the housing. The spring elements assist in keeping the one or more vibration sensors in contact with each other and the membrane so that the movement of the vibration sensor(s) correlates to the membrane motion. Membrane motion may include flexural motion which may entail bending, compression and/or shear deformation of the membrane. The implantable microphone may further include an element positioned between the vibration sensor and the membrane. The element may be configured to move the vibration sensor in response to movement from the membrane. The recess may include a channel extending to at least one sidewall of the housing. The recess in the back wall may be substantially aligned with a center of the membrane. The vibration sensor may include a stack of vibration sensors. The vibration sensor may be coupled to the membrane. The membrane may further include a structure substantially positioned at the center of the membrane.

In accordance with another embodiment of the invention, an implantable microphone configured to be coupled to an auditory ossicle includes a housing having a top portion, a back wall, and a sidewall between the top portion and the back wall. The implantable microphone also includes a membrane coupled to the top portion of the housing and a vibration sensor coupled to the sidewall and adjacent to the membrane. The membrane is configured to move in response to movement from the auditory ossicle and the vibration sensor is configured to measure the movement of the membrane and convert the measurement into an electrical signal.

In accordance with another embodiment of the invention, an implantable microphone for use in hearing systems includes a housing having a back wall, a first membrane coupled to a top portion of the housing, and a second membrane coupled to the back wall of the housing. The first and second membranes are configured to move in response to movement from an adjacent auditory ossicle. The microphone also includes a vibration sensor in contact with the first and second membranes. The vibration sensor is configured to measure the movement of the first and second membranes.

In accordance with another embodiment of the invention, an implantable microphone may be designed without a rigid housing, but instead has flexible membranes that act as the housing which are encapsulated by a single or multilayer coating film. Accordingly, an implantable microphone for use in hearing systems includes a vibration sensor and a flexible housing surrounding the vibration sensor. The housing includes a first membrane and a second membrane and both membranes are configured to move in response to movement from an adjacent auditory ossicles. The first membrane and/or the second membrane is in contact with the vibration sensor. The implantable microphone may further include one or more additional vibration sensors adjacent to the vibration sensor. The flexible housing may surround the vibration sensor and the one or more additional vibration sensors and the first membrane and/or the second membrane may be in contact with the vibration sensor and/or one or more of the additional vibration sensors. The vibration sensor and the one or more additional vibration sensors may be separated by a space. The space may include a material that is electrically insulating and that is an elastic, viscous, and/or viscoelastic material. The implantable microphone may further include one or more clamping elements electrically connecting one portion of the vibration sensor to one portion of the one or more additional vibration sensors. The membranes may be encapsulated by an hermetic, elastic, bio resistant and/or bio compatible coating film or films. The vibration sensor may include one or more sensor elements formed by one or more vibration sensor elements or by a stack of vibration sensor elements. The sensing elements, in combination with the encapsulation, may be mechanically designed in such a way as to have approximately the same mechanical characteristics (e.g., elasticity) as that of the cartilage of a joint in the ossicle chain, e.g., the incudo stapedial joint.

BRIEF DESCRIPTION OF THE DRAWINGS

The foregoing features of the invention will be more readily understood by reference to the following detailed description, taken with reference to the accompanying drawings, in which.

DESCRIPTION OF ILLUSTRATIVE EMBODIMENTS

Various embodiments of the present invention provide an implantable microphone for use in hearing systems, such as cochlear implant systems. The implantable microphone includes a housing having a back wall with an opening configured to be coupled to an auditory ossicle. The implantable microphone also includes a membrane coupled to a top portion of the housing and a vibration sensor adjacent to the membrane. The membrane is configured to move in response to movement from the auditory ossicle, and the vibration sensor is configured to measure the movement of the membrane and to convert the measurement into an electrical signal. This configuration allows the implantable microphone to be used within the middle ear without additional rigid support structures to hold the microphone in place. The configuration also allows flexibility in the orientation of the microphone within the middle ear based on a patient's anatomical or surgical requirements. In addition, the configuration allows the placement of the microphone to be optimized on the auditory ossicle, providing an increase in the sensitivity of the device. Reducing the amount of space needed for the microphone also allows the middle ear elements to undergo less trauma, e.g., less bone or cartilage needs to be removed. Details of illustrative embodiments are discussed below.

Figure 1:
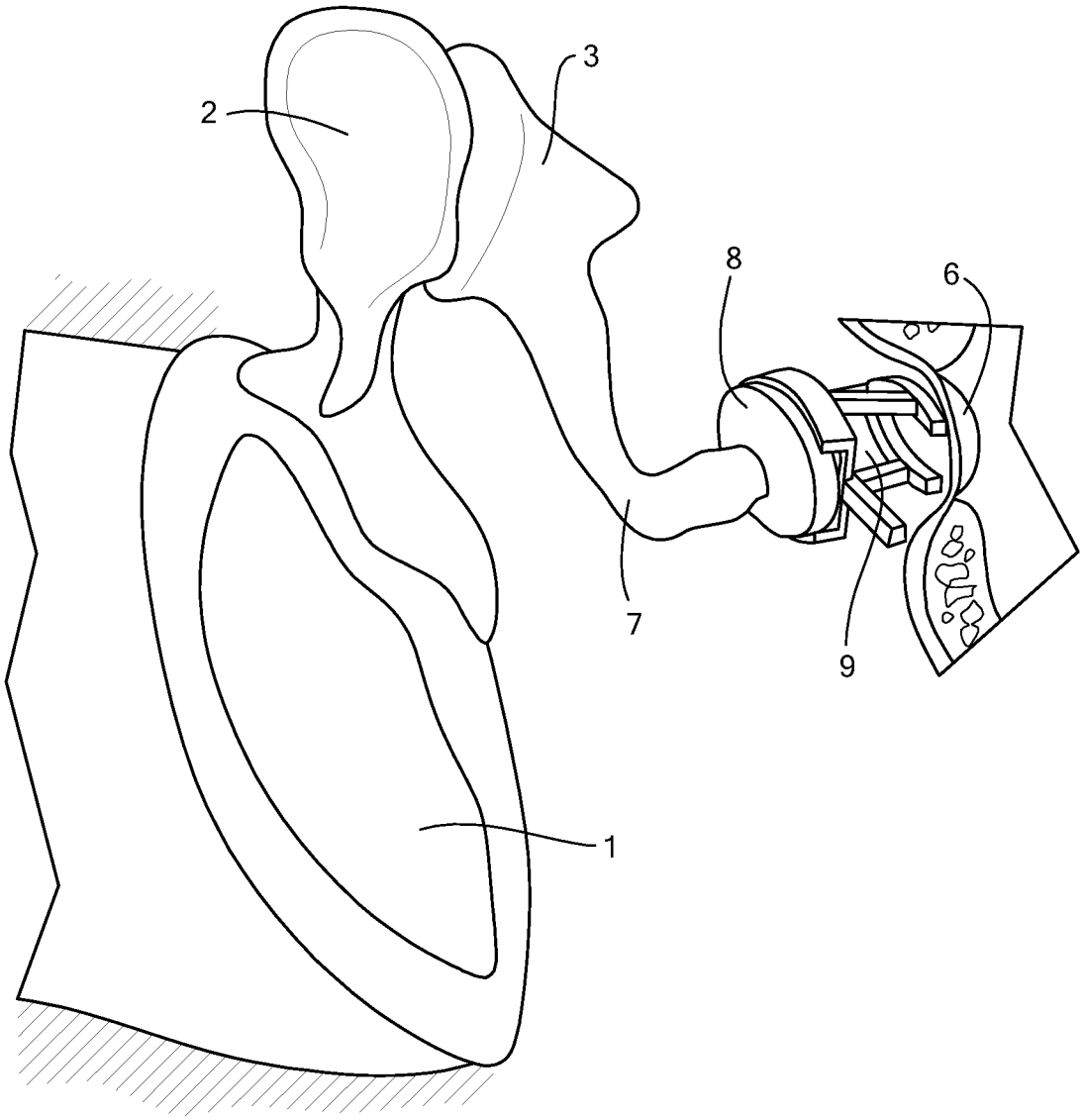
FIG. 1 PRIOR ART
FIG. 1 shows elements of the middle ear with an implanted converter according to the prior art.

In a normal functioning ear, sounds are transmitted through the outer ear to the tympanic membrane (eardrum), which moves the ossicles of the middle ear (malleus, incus, and stapes). The middle ear transmits these vibrations to the oval window of the cochlea or inner ear. The cochlea is filled with cerebrospinal fluid, which moves in response to the vibrations coming from the middle ear via the oval window. In response to the received sounds transmitted by the middle ear, the fluid-filled cochlea functions as a transducer to generate electric pulses which are transmitted to the cochlear nerve and ultimately to the brain. FIG. 1 shows elements of a human ear with a prior art implantable converter. As shown, the implantable converter 8 is positioned between the articular cartilage 7 of the severed malleus-incus joint and the recess of the oval window 6 and held in place with a post 9, which is affixed in the bone channel of the stapes tendon. The oscillations of the ear drum 1 are transmitted from the malleus 2, incus 3 and articular cartilage 7 to a thin shell on the implantable converter 8. This prior art configuration, however, requires additional support structures to hold the implantable converter in place within the middle ear ossicles chain.

Figure 2:
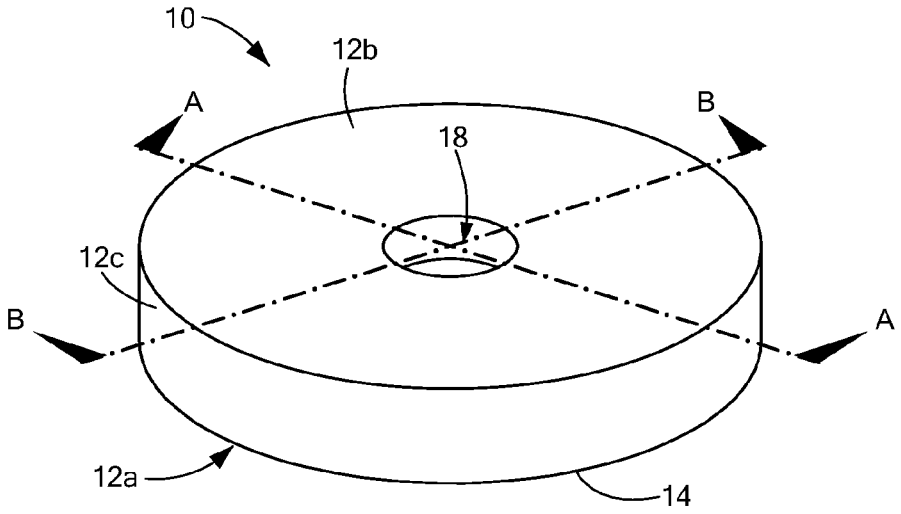
FIG. 2 schematically shows a perspective view of an implantable microphone according to embodiments of the present invention.
Figure 3:
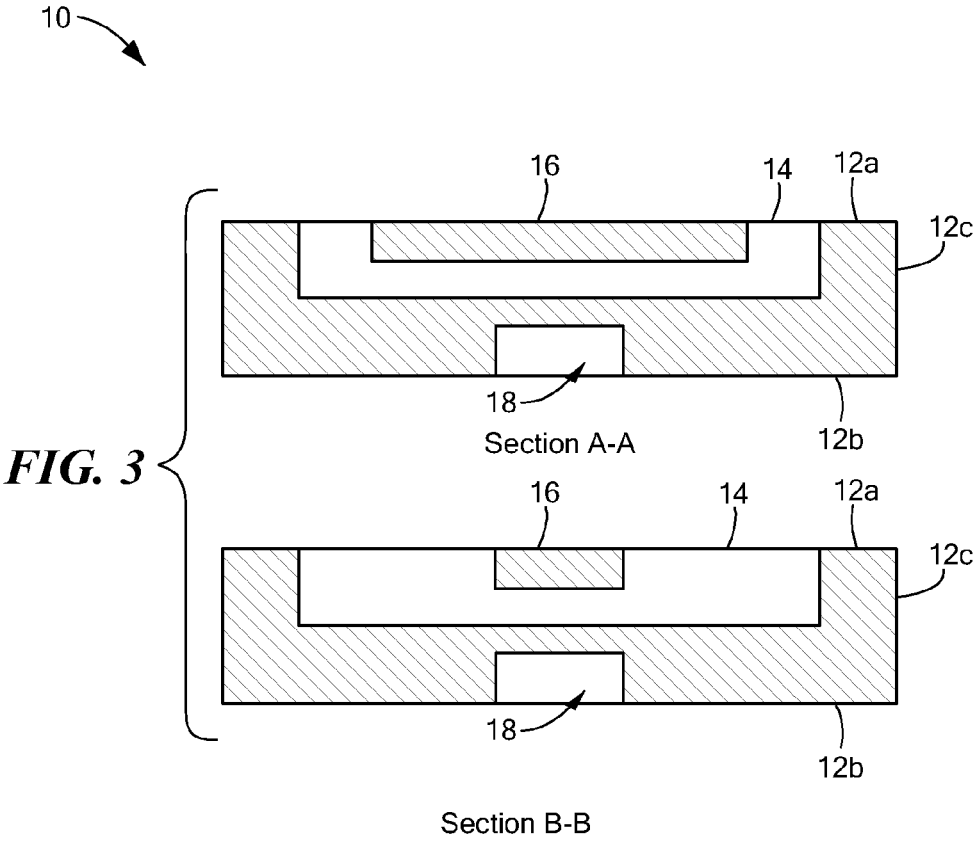
FIG. 3 schematically shows a cross-sectional view of an implantable microphone along lines A-A and B-B of FIG. 2 according to embodiments of the present invention.

FIG. 2 schematically shows a perspective view of an implantable microphone 10 according to embodiments of the present invention and FIG. 3 schematically shows a cross-sectional view of the implantable microphone 10 along lines A-A and B-B of FIG. 2. As shown, the implantable microphone 10 includes a housing 12 having a top portion 12*a*, a back wall 12*b*, and a sidewall 12*c* between the top portion 12*a* and the back wall 12*b*. The implantable microphone 10 also includes a membrane 14 coupled to the top portion 12*a* of the housing 12 and a vibration sensor 16 adjacent to the membrane 14. The membrane 14 is configured to move in response to movement from the auditory ossicle, and the vibration sensor 16 is configured to measure the movement of the membrane 14 and to convert the measurement into an electrical signal.

The membrane 14 may be coupled to the housing 12 in such a way as to provide a hermetically sealed interior area within the housing 12 where the vibration sensor 16 is provided. The housing 12 and the membrane 14 may be made of any suitable biocompatible material, e.g., material enabling hermetical sealing. In addition, the membrane 14 material should have a certain amount of elasticity. For example, the housing 12 and membrane 14 may be made from metal (e.g., niobium, titanium, alloys thereof, etc. with various crystal structures, e.g., mono crystalline silicon, etc.) or any kind of ceramics (e.g., aluminum oxide such as ruby or sapphire) or plastic material (e.g., epoxy, PMMA, etc.). The biocompatible materials may be biocompatible coated materials (e.g., coating material such as parylene, platinum plating, SiO2, etc.). The membrane 14 may be coupled to the housing 12, depending on the respective materials used, by any known technique, e.g. welding (ultrasonic welding, laser welding, etc.), brazing, bonding, etc. Similarly, the vibration sensor 16 may be coupled to the membrane 14, depending on the respective materials used, by any known technique, e.g., adhesive, electrically conductive adhesive, etc. Although the vibration sensor 16 is shown coupled to the membrane 14 in FIG. 3, the vibration sensor 16 may also be coupled to the sidewall 12*c*, as discussed in more detail below. Similarly, although the housing 12 is shown in FIG. 2 having a round, cylindrical shape, the housing 12 may have any suitable shape, e.g., cylindrical with an oval or circular cross-sectional shape, rectangular with a square or rectangular cross-sectional shape, or a cube, etc., but preferably the shape does not exceed about 6 mm×4 mm×2 mm in size. The implantable microphone 10 may also include one or more hermetically sealed electrically insulated feedthroughs (not shown) through the housing 12 so that the electrical signal from the vibration sensor 16 may be carried from the hermetically sealed interior area to outside of the housing 12.

The back wall 12*b* of the housing 12 has a recess (e.g., blind hole) 18 configured to be coupled to an auditory ossicle, as discussed in more detail in FIGS. 4 and 5 below. Preferably, the recess 18 is substantially aligned with a center of the membrane 14, such as shown in FIG. 3. This allows the placement of the microphone 10 to be optimized on the auditory ossicle, increasing the sensitivity of the microphone 10. In addition, the membrane 14 may further include a structure (not shown) substantially positioned at the center of the membrane 14 to optimize the placement of the microphone 10 on the auditory ossicle. The structure may be etched into the membrane 14, deposited onto the membrane 14 or mounted onto the membrane 14.

Figure 5:
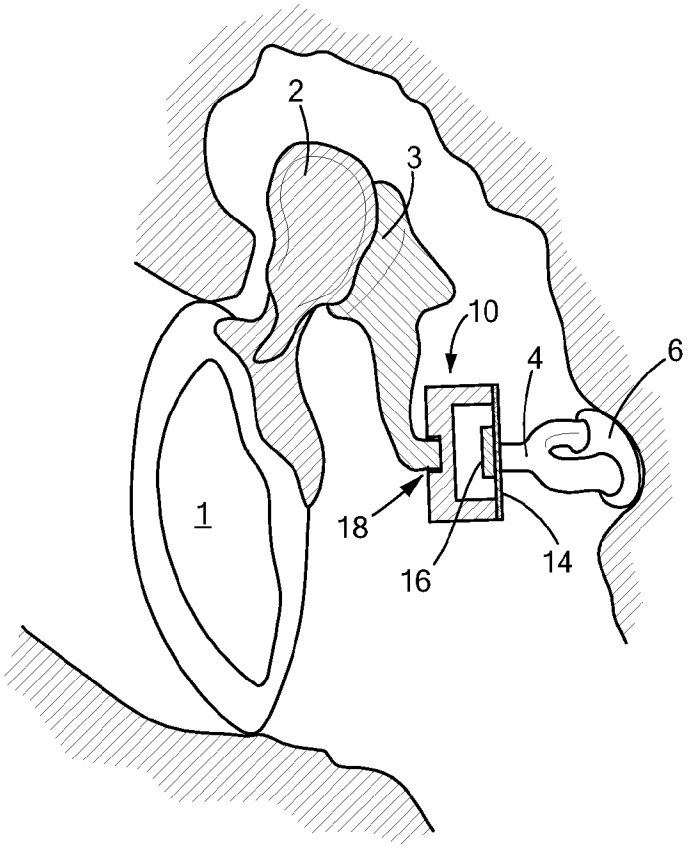
FIG. 5 schematically shows an implantable microphone positioned in another orientation within the ossicle chain according to embodiments of the present invention.
Figure 4:
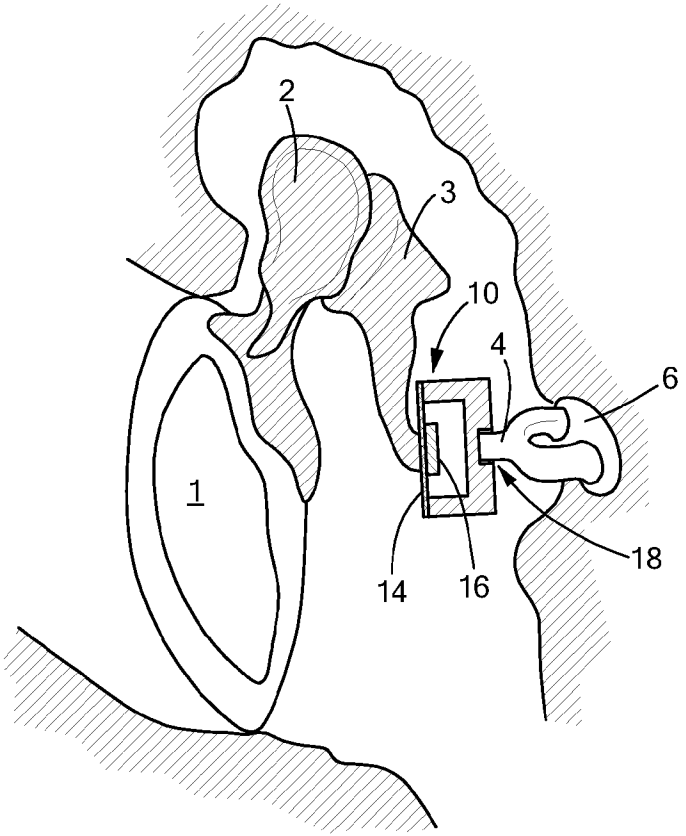
FIG. 4 schematically shows an implantable microphone positioned in one orientation within the ossicle chain according to embodiments of the present invention.

FIGS. 4 and 5 schematically show an implantable microphone 10 positioned in different orientations within the ossicles chain. As shown in FIG. 4, the back wall 12*b* of the housing 12 may be facing towards the stapes 4 or oval window 6 and the membrane 14 may be facing towards the incus 3 or the ear drum 1. In this embodiment, the recess 18 in the back wall 12*b* allows the implantable microphone 10 to be held in position on a portion of the stapes 4. If an additional structure is provided on the membrane 14, the structure further allows the implantable microphone 10 to be held in position on a portion of the incus 3. Alternatively, as shown in FIG. 5, the back wall 12*b* of the housing 12 may be facing towards the incus 3 or the ear drum 1 and the membrane 14 may be facing towards the stapes 4 or oval window 6. In this embodiment, the recess 18 in the back wall 12*b* allows the implantable microphone 10 to be held in position on a portion of the incus 3. If an additional structure is provided on the membrane 14, the structure further allows the implantable microphone 10 to be held in position on a portion of the stapes 4. Centering the membrane 14 on the auditory ossicle improves the sensitivity of the microphone 10. Thus, embodiments of the present invention permit the orientation of the microphone 10 to be varied depending on a patient's anatomical or surgical requirements. Although not shown, one or more spring elements may be used with the implantable microphone 10 in order to further secure the microphone 10 within the ossicle chain. The spring element(s) may be coupled to a portion of the implantable microphone 10 and act as a flexible support member between the implantable microphone 10 and one or more components of the ossicle chain. For example, the flexible support member may be anchored in the eminentia pyramidalis (triangle of tendons and muscles within the tympanum 1) since this area is capable of anchoring an interface cable that may lead to the implantable microphone 10.

Figure 7:
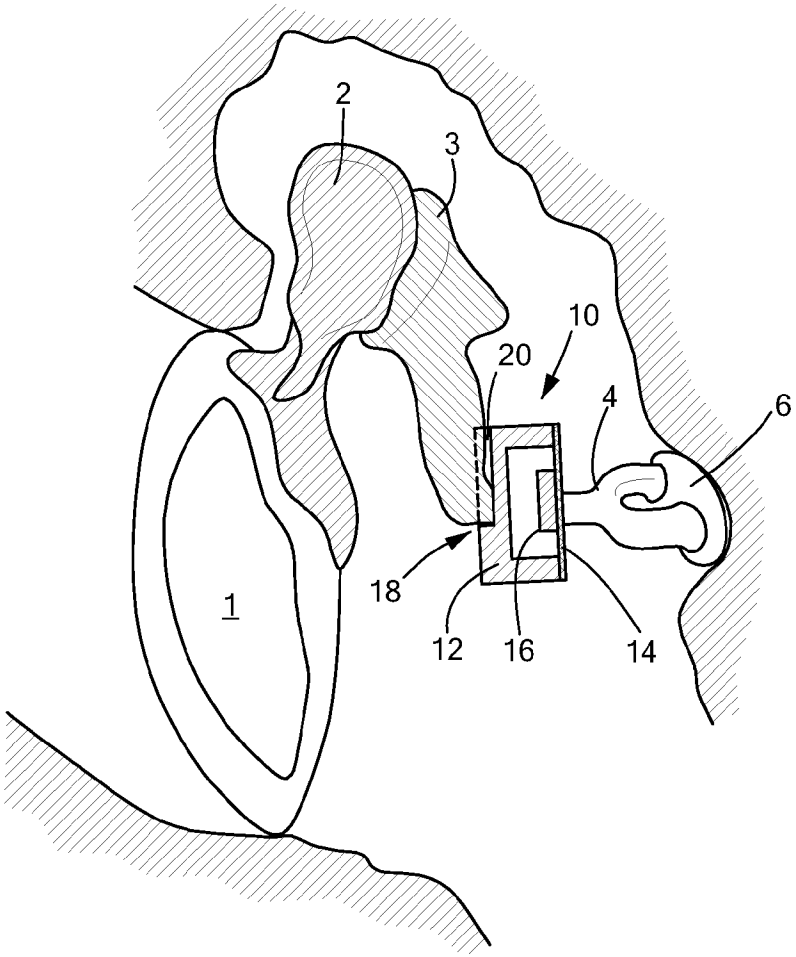
FIG. 7 schematically shows an implantable microphone having a recess that includes a channel positioned within the ossicle chain according to embodiments of the present invention.
Figure 6:
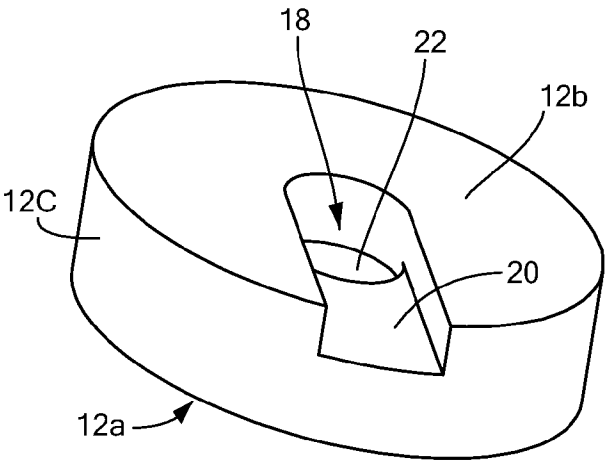
FIG. 6 schematically shows a perspective view of an implantable microphone having a recess (e.g., blind hole) in the housing that includes a channel according to embodiments of the present invention.

FIG. 6 schematically shows a perspective view of an implantable microphone 10 having a recess 18 in the housing 12 that includes a channel 20 extending from a center of the back wall 12*b* to at least one area in the sidewall 12*c* of the housing 12. The recess 18 may include a further recessed area 22, e.g., at the center of the back wall 12*b*. The channel 20 and recessed area 22 may allow the implantable microphone 10 to be further positioned and secured onto the auditory ossicles, such as shown in FIG. 7. The channel 20 may reduce any lateral movement of the microphone 10 once it is placed onto a portion of the stapes 4 or the incus 3. After fixation of the housing 12, the channel 20 may be placed parallel to the incus 3 thus avoiding space conflicts between the incus 3 and the housing 12.

Figure 8A:
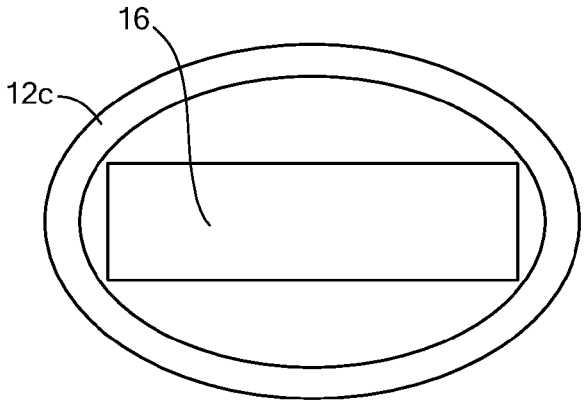
FIGS. 8A and 8B schematically show a top view and perspective view, respectively, of elements of the implantable microphone according to embodiments of the present invention.
Figure 8B:
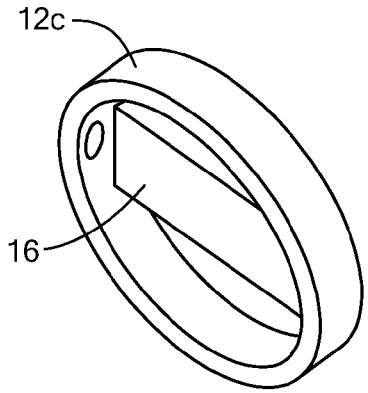
Figure 20:
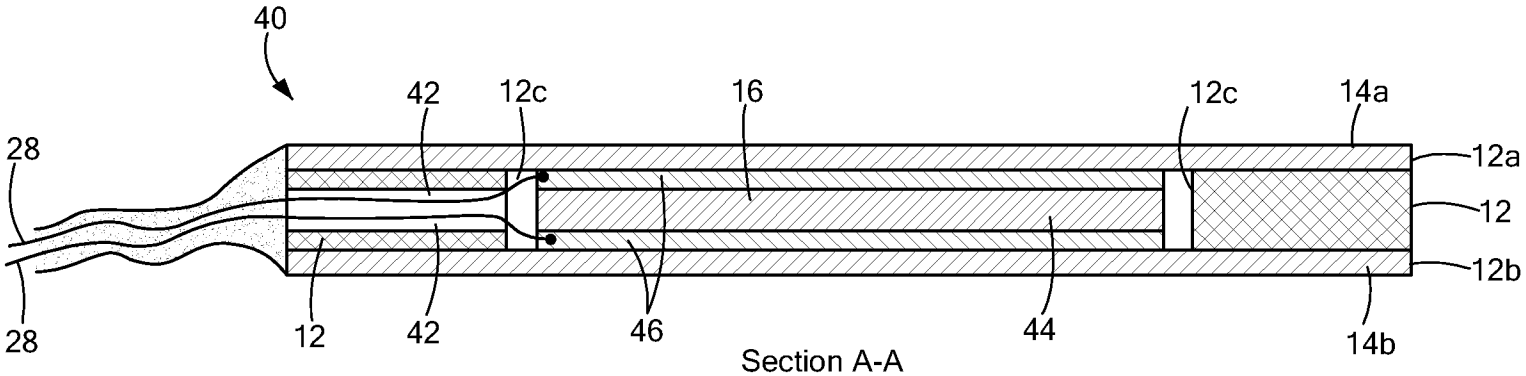
FIG. 20 schematically shows a cross-sectional view of an implantable microphone along lines A-A of FIG. 19 according to embodiments of the present invention.
Figure 25:
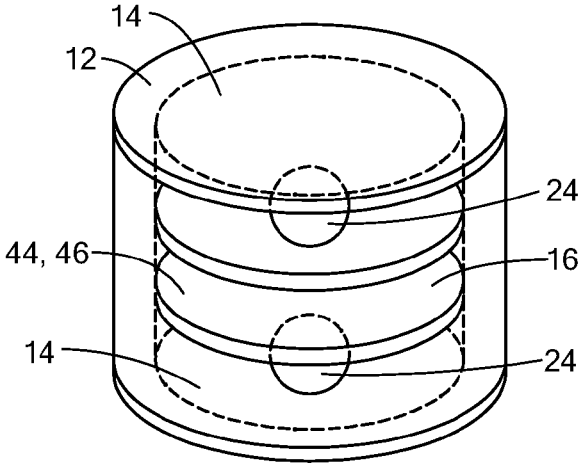
FIG. 25 schematically shows a perspective view of a stack of vibration sensors within a cylindrical housing according to embodiments of the present invention.
Figure 26:
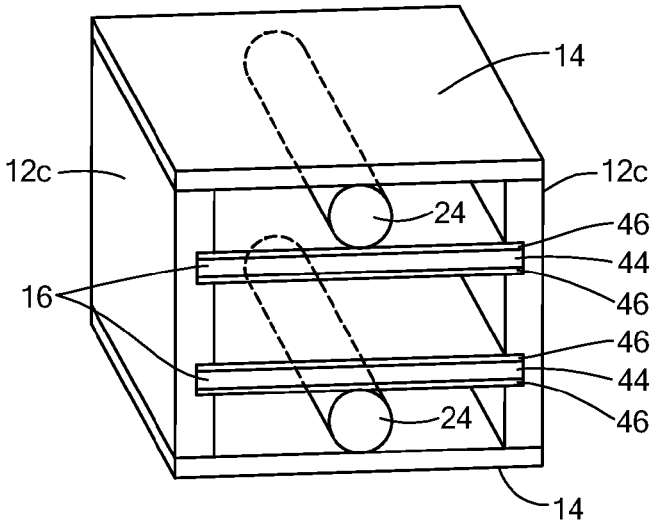
FIG. 26 schematically shows a perspective view of a stack of vibration sensors within a rectangular housing according to embodiments of the present invention.

The vibration sensor 16, preferably, is a piezoelectric sensor, which may be formed of a single crystal material. The piezoelectric sensor may include one or more piezoelectric sensor elements 44 (such as shown in FIG. 20), which may be formed of a piezoelectric material. Piezoelectric materials may include piezoelectric crystal materials, piezoelectric ceramic materials, piezoelectric polymer foam or foil structures (e.g., polypropylene) that include electroactive polymers (EAPs), such as dielectric EAPs, ionic EAPs (e.g., conductive polymers, ionic polymer-metal composites (IPMCs)), and responsive gels such as polyelectrolyte material having an ionic liquid sandwiched between two electrode layers, or having a gel of ionic liquid containing single-wall carbon nanotubes, etc, although other suitable piezoelectric materials may be used. The piezoelectric sensor may be in the shape of a thin, rectangular bar (such as shown in FIGS. 8A and 8B), a circular plate (such as shown in FIG. 25), a square plate (such as shown in FIG. 26), etc., depending on the shape of the housing 12 used, although other shapes may also be used. The vibration sensor 16 measures the movement of the membrane 14 and converts the measurement into an electrical signal. For example, a piezoelectric sensor having one or more sensor elements 44 may include electrodes 46 on either side of the sensor elements 44 (such as shown in FIG. 20). The movement of the piezoelectric sensor causes deformation of the piezoelectric material, which in turn evokes voltage and charge transfer on at least two electrodes 46 of the sensor 16, thus providing a voltage or charge measurement signal. The sensor element(s) 44 may be formed by a stack of piezoelectric foils or by folded piezoelectric foils. The folding or stacking may help to increase voltage or charge yield.

Figure 9:
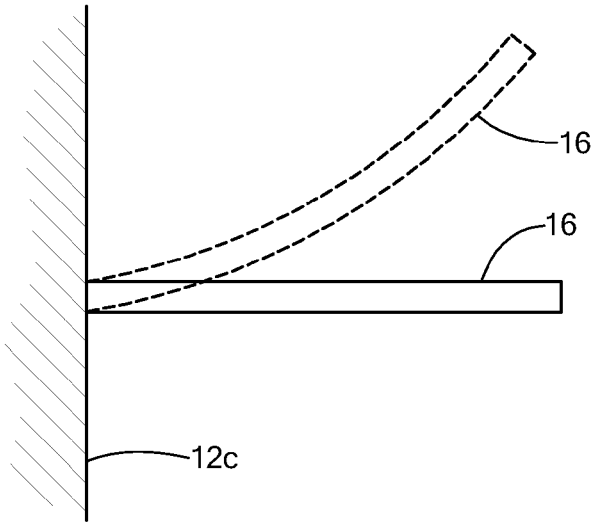
FIG. 9 schematically shows a side view of a housing sidewall and a vibration sensor in a flexed and unflexed position according to embodiments of the present invention.
Figure 10A:
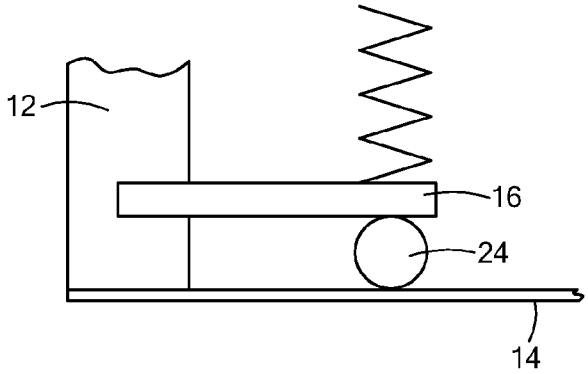
FIGS. 10A and 10B schematically show a side view and a top view, respectively, of a housing sidewall and a vibration sensor with an element coupled to its one end according to embodiments of the present invention.
Figure 10B:
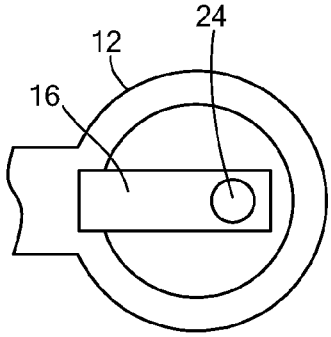

As mentioned previously, the vibration sensor 16 may be coupled to the membrane 14. Alternatively, or in addition, the vibration sensor 16 may be coupled to the sidewall 12*c*, such as shown in FIGS. 9, 10A and 10B, by any known technique. For example, the vibration sensor 16 may have one end coupled to the sidewall 12*c* and the other end free to move, may have two ends coupled to the sidewall 12*c*, or may have substantially all edges coupled to the sidewall 12*c*. As shown in FIG. 9, the vibration sensor 16 having one end coupled to the sidewall 12*c* allows the vibration sensor 16 to be held secure at one end, at the sidewall 12*c* of the housing 12, but allows the vibration sensor 16 to flex toward its other end in response to movement from the membrane 14. FIG. 9 shows the vibration sensor in a flexed (dotted line showing the vibration sensor 16) and unflexed (solid line showing the vibration sensor 16) position. The benefit of this type of configuration is that the cantilever bar vibration sensor 16 is driven by the membrane 14 deflection and acts as a bending spring. However, since the vibration sensor 16 does not follow the membrane 14 contour, it avoids the counter rotating bending momentums that lead to erroneous compensating charges on the vibration sensor's surface.

When the vibration sensor 16 is coupled to the sidewall 12*c*, an element 24 may be placed between the vibration sensor 16 and the membrane 14. The element 24 may be configured to assist in keeping the vibration sensor 16 in contact with the membrane 14 so that the vibration sensor 16 moves in response to movement from the membrane 14. FIGS. 10A and 10B show a side view and a top view, respectively, of a vibration sensor 16 coupled to the housing 12 at one end and having an element 24 coupled to its other end. The element 24 may be in the shape of a spherical ball, cylindrical bar, or rectangular bar, although other shapes may also be used.

Figure 11:
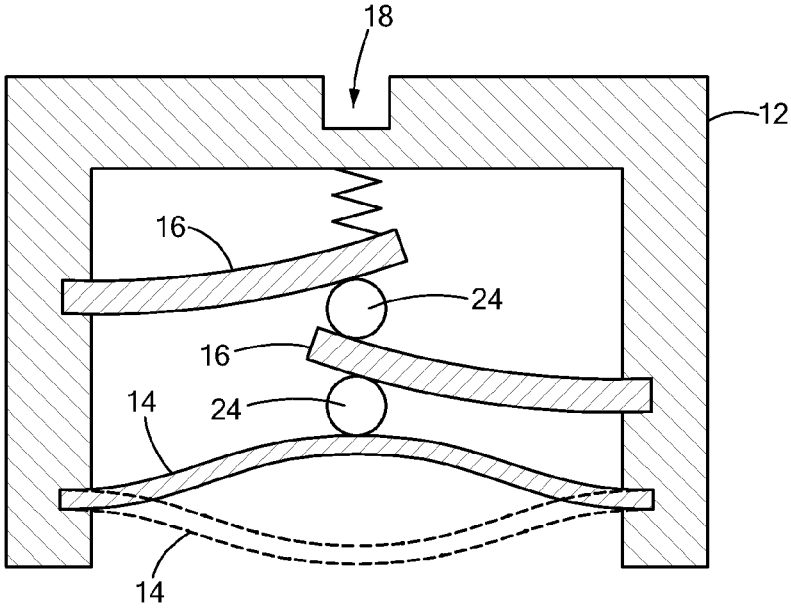
FIG. 11 schematically shows a side view of an implantable microphone having two vibration sensors according to embodiments of the present invention.

One or more vibration sensors 16 may be used in the implantable microphone 10 and may be coupled to one or more areas in the sidewall 12*c* of the housing 12. For example, FIG. 11 shows a side view of an implantable microphone 10 having two vibration sensors 16, although more than two may be used. The vibration sensors 16 may be coupled to the same side of the sidewall 12*c*, coupled to opposite sides of the sidewall 12*c*, such as shown in FIG. 11, and/or coupled to the sidewall 12*c* substantially around its interior. The vibration sensors 16 may include one or more elements 24 that may be placed between the membrane 14 and the vibration sensor 16 or between each of the vibration sensors 16. The element(s) 24 assist in keeping the vibration sensors 16 in contact with each other and with the membrane 14 so that the movement of the vibration sensors 16 correlates to the membrane motion. One or more vibration sensors 16 may substantially span the interior of the housing 12, such as shown in FIGS. 8A and 8B. Alternatively, or in addition, one or more vibration sensors 16 may span only a portion of the interior of the housing 12, such as shown in FIG. 11.

Figure 12:
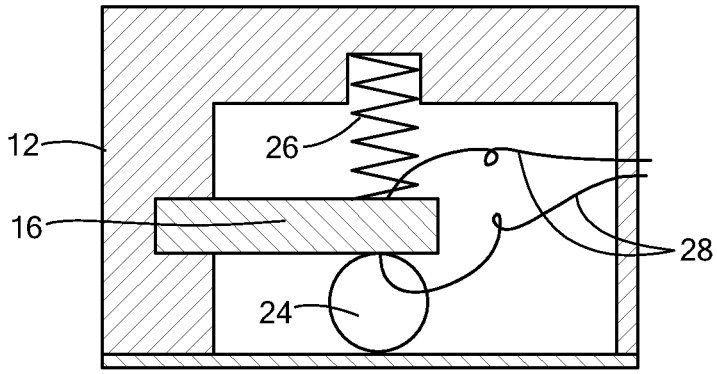
FIG. 12 schematically shows a side view of an implantable microphone having a vibration sensor with a spring element and element attached according to embodiments of the present invention.

The implantable microphone 10 may further include one or more spring elements 26 positioned between the one or more vibration sensors 16 and the housing 12. The one or more spring elements 26 may assist in keeping the one or more vibration sensors 16 in contact with each other and the membrane 14 so that the movement of the vibration sensor(s) 16 correlates to the membrane motion. For example, membrane motion may include flexural motion which may entail bending, compression and/or shear deformation of the membrane 14. The vibration sensor(s) 16, driven by the membrane movement, may thus also undergo flexural motion (e.g., bending, compression and/or shear deformation of the sensor) in a manner that correlates to the movement of the membrane 14. For example, FIG. 12 shows a side view of an implantable microphone 10 having a vibration sensor 16 with a spring element 26 and element 24 coupled to its one end. The implantable microphone 10 also includes leads 28 providing an electrical coupling to the vibration sensors 16. FIG. 12 shows the leads 28 coupled to the vibration sensor 16 and leading out of the housing 12 (through feedthrough (not shown)). However, the leads 28 have been omitted from most of the figures in order to simplify the discussion. As known by those skilled in the art, the signal leads 28 and cables may be made of any kind of electrically conductive material, e.g., metals such as copper, gold, aluminium, etc. and alloys thereof, conductive polymers such as polyethylene sulphide, poly(acetylene)s, poly(pyrrole)s, poly(thiophene)s, polyanilines, polythiophenes, poly(p-phenylene sulfide), and poly (para-phenylene vinylene)s (PPV) coated with an insolating film of material such as parylene, epoxy, silicone, etc., or combinations thereof The leads 28 may be designed as flexible printed circuit boards, which may be based on thin film technology. The leads 28 are configured to transfer an electrical signal from the sensor 16 to an implantable device, such as a cochlear implant. Preferably, the leads 28 are designed as flexible as possible to avoid restoring and/or damping forces that may cause losses in the detected motion of the middle ear components.

The leads 28 may be designed to also act as flexible support members, such as mentioned above with respect to FIGS. 4 and 5, in order to additionally secure the implantable microphone 10 within the ossicle chain.

Figure 13:
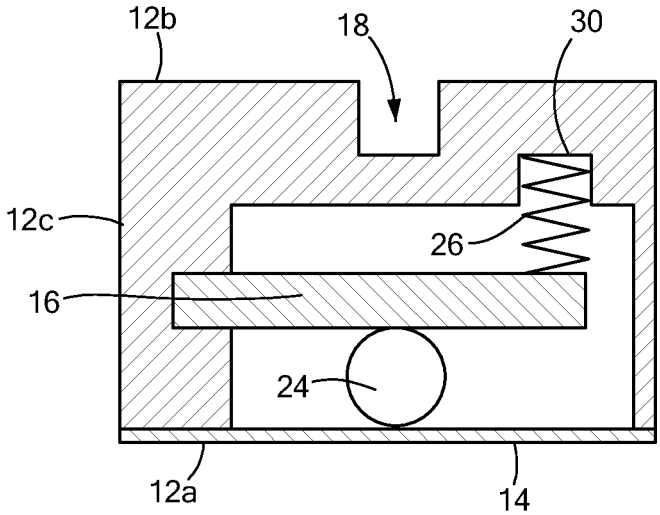
FIG. 13 schematically shows a side view of an implantable microphone having a vibration sensor with a spring element attached near its one end according to embodiments of the present invention.
Figure 14:
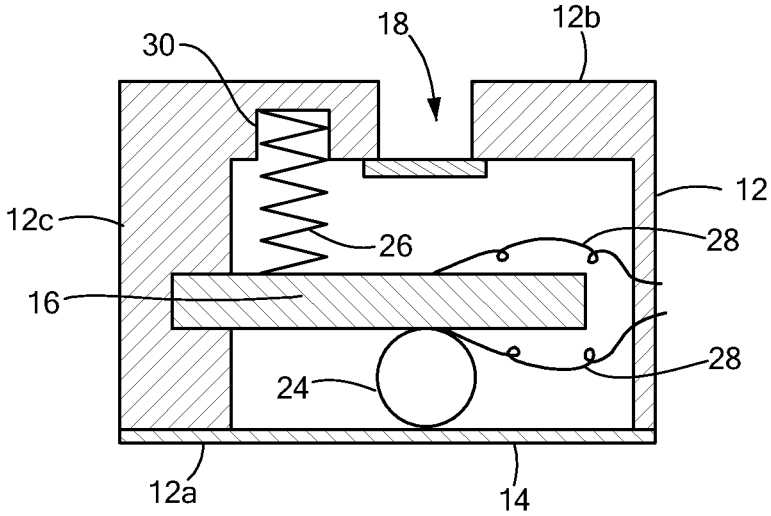
FIG. 14 schematically shows a side view of an implantable microphone having a vibration sensor with a spring element attached near the sidewall according to embodiments of the present invention.

The housing 12 may include a groove 30 in the back wall 12*b* on the interior of the housing 12 for the spring element 26 to fit within, such as shown in FIGS. 13 and 14. The spring element 26 may be coupled toward one end of the vibration sensor toward its free end, such as shown in FIG. 13, or may be coupled toward its secured end, such as shown in FIG. 14. Similarly, the groove 30 may be located on either side of the recess 18 in the back wall 12*b*, such as shown in FIGS. 13 and 14, depending on the position of the spring element 26 in relation to the vibration sensor 16.

Figure 15A:
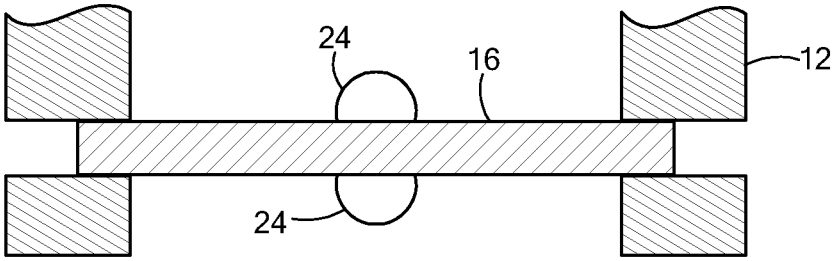
FIGS. 15A and 15B schematically show a side view of a vibration sensor coupled to two locations in the sidewall according to embodiments of the present invention.
Figure 15B:
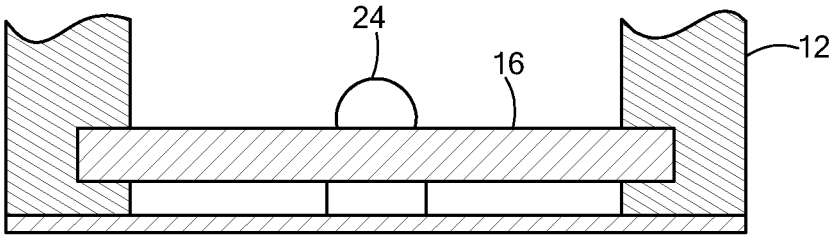

Although the vibration sensors 16 have been shown with one end coupled to the sidewall 12*c* and the other end free to move, both ends of the vibration sensors 16 may be coupled to the sidewall 12*c*, such as shown in FIGS. 15A and 15B. In this embodiment, the microphone 10 may include elements 24 between the membrane 14 and the vibration sensor 16 or between each of the vibration sensors 16. The elements 24 may be on both sides of the vibration sensor 16, such as shown in FIGS. 15A or on one side of the vibration sensor 16, such as shown in FIG. 15B, preferably toward its middle.

Figure 16:
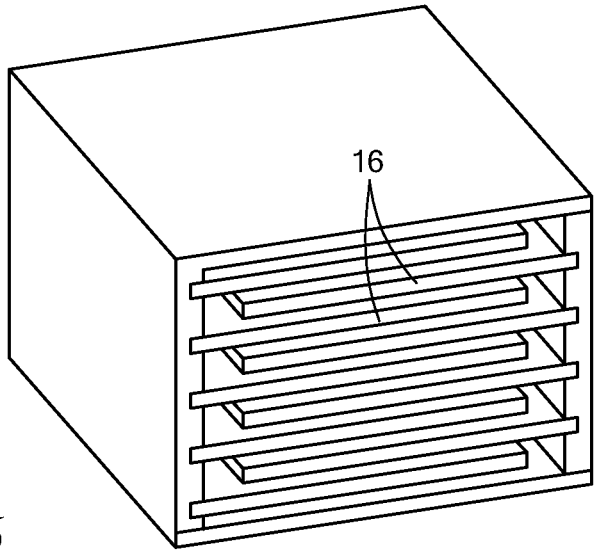
FIG. 16 schematically shows a perspective view of a stack of vibration sensors according to embodiments of the present invention.

The vibration sensors 16 may be configured as a stack of vibration sensors 16. FIG. 16 schematically shows a perspective view of a stack of vibration sensors 16 that may be used within the housing 12. The multilayer stack may include, for example, alternating layers of piezoelectric material and conductive material, each layer as thin as possible. The multilayer stack may be configured as parallel capacitors for maximum charge yield or may be configured as serial capacitors for maximum voltage yield.

Figure 18:
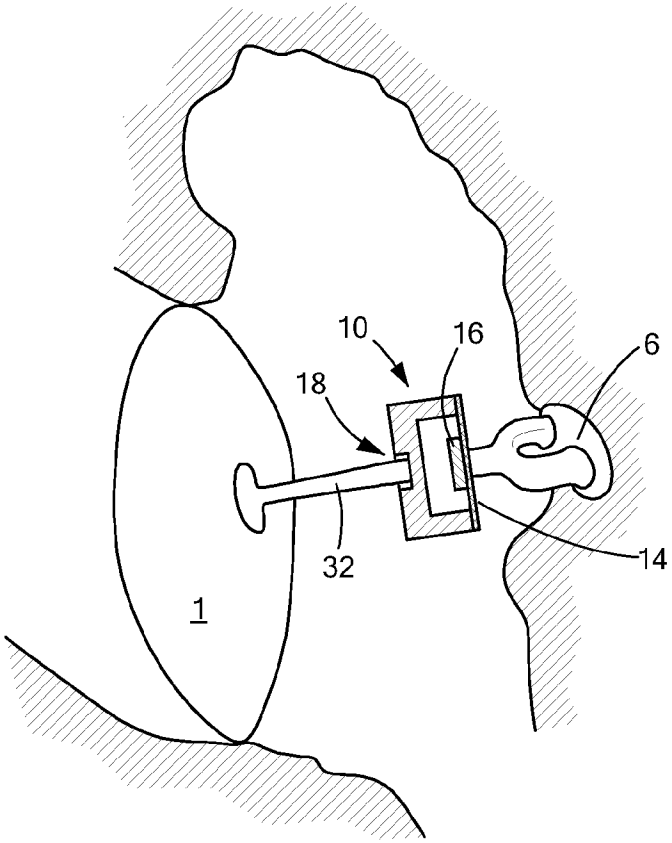
FIG. 18 schematically shows an implantable microphone coupled to the tympanic membrane in another orientation according to embodiments of the present invention.
Figure 17:
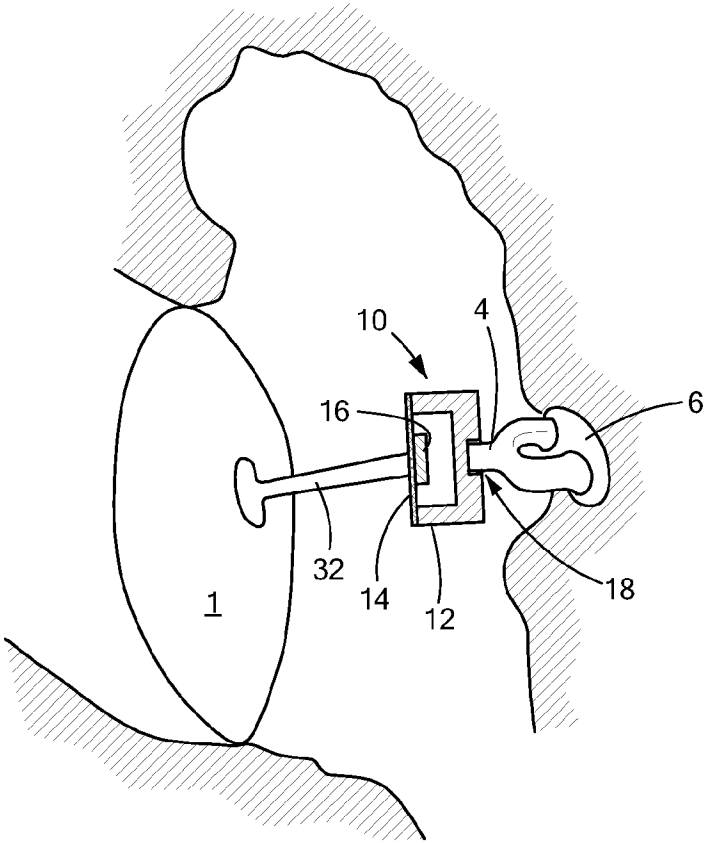
FIG. 17 schematically shows an implantable microphone coupled to the tympanic membrane in one orientation according to embodiments of the present invention.

Although the implantable microphone 10 was shown in FIGS. 4, 5, and 7 positioned between the incus 3 and the stapes 4, the implantable microphone 10 may be used in other configurations. For example, as shown in FIGS. 17 and 18, the implantable microphone 10 may be positioned between the stapes 4 (or oval window 6) and ear drum 1 with an additional piece of a stapes prosthesis 32.

Figure 19:
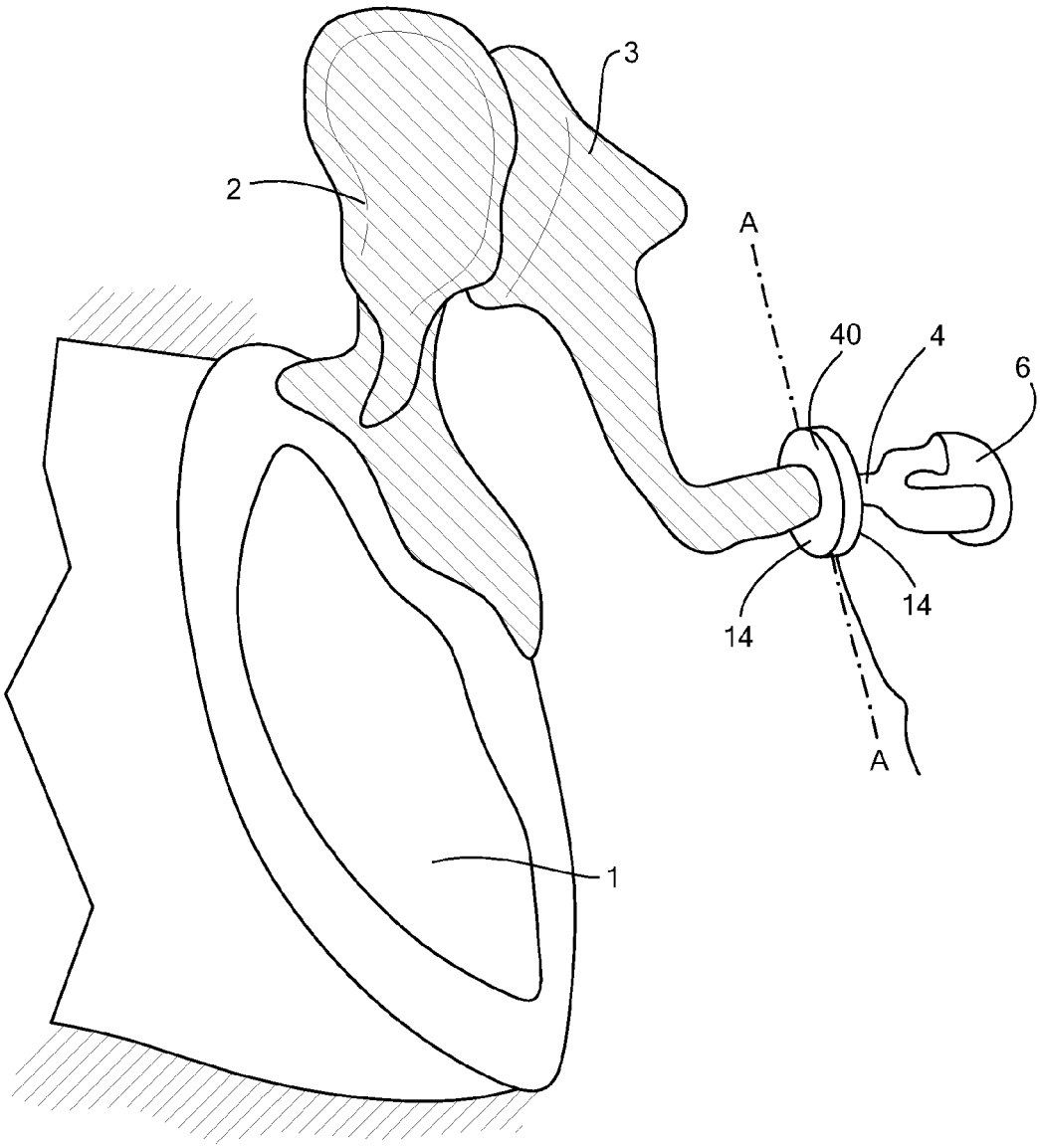
FIG. 19 schematically shows an implantable microphone positioned within the ossicle chain according to embodiments of the present invention.

FIG. 19 schematically shows another embodiment of an implantable microphone positioned within the ossicles chain. As mentioned above, the microphone may be configured to be inserted between two ossicles (e.g., between the incus 3 and the stapes 4 or between the malleus 2 and the stapes 4) or between any part of the ossicles. In this embodiment, the implantable microphone 40 includes a housing 12 having two membranes 14 instead of the one membrane 14 and a back wall 12*b* as mentioned above.

As shown in FIG. 20, the housing 12 may be shaped as a ring with a first membrane 14*a* coupled to the top portion 12*a* of the housing 12 and a second membrane 14*b* coupled to the back wall 12*b* of the housing 12. Both the first and second membranes 14*a*, 14*b* are configured to move in response to movement from an adjacent auditory ossicles. One or more vibration sensors 16 are adjacent to, or in contact with, one or both membranes 14*a*, 14*b*. For example, FIG. 20 shows one vibration sensor 16 adjacent to both membranes 14*a*, 14*b*, and FIGS. 25-29 show two vibration sensors 16, one sensor 16 in contact with the first membrane 14*a* through the element 24 and the second sensor 16 in contact with the second membrane 14*b* through another element 24. FIG. 30 shows another embodiment with more than two vibration sensors 16.

Referring again to FIG. 20, the vibration sensor 16 may include one or more sensor elements 44 and an electrode 46 on either side of the sensor element(s) 44. Piezoelectric materials may include piezoelectric crystal materials, piezoelectric ceramic materials, piezoelectric polymer foam or foil structures (e.g., polypropylene) that include electroactive polymers (EAPs), such as dielectric EAPs, ionic EAPs (e.g., conductive polymers, ionic polymer-metal composites (IP- MCs)), and responsive gels such as polyelectrolyte material having an ionic liquid sandwiched between two electrode layers, or having a gel of ionic liquid containing single-wall carbon nanotubes, etc., although other suitable piezoelectric materials may be used. The vibration sensor 16 is configured to measure the movement of both membranes 14*a*, 14*b* and to convert the measurements into an electrical signal. The movement of the membranes 14*a*, 14*b* is caused by the movement of the ossicles adjacent to each respective membrane 14*a*, 14*b*. The movement measured by the vibration sensor 16 may include the relative movement of both membranes 14*a*, 14*b* with respect to each other. As mentioned above, the vibration sensor 16 may be a piezoelectric sensor having one or more sensor elements 44. The one or more piezoelectric sensor elements 44 may substantially fill the space between the two membranes 14*a*, 14*b* (such as shown in FIG. 20), or there may be spaces between the one or more sensor elements 44 (such as shown in FIGS. 25-30). The diameter of each membrane 14 may be configured to substantially conform to the diameter of the adjacent ossicle. As mentioned previously, the housing 12 may have one or more feedthroughs 42 formed in its sidewall 12*c* so that the electrical signal from the vibration sensor 16 may be carried by the leads 28 from the interior area to outside of the housing 12.

The membranes 14*a*, 14*b* may further include structure(s) (not shown) substantially positioned at the center of one or both membranes 14*a*, 14*b* which help to center the microphone 40 and which may help to additionally secure the microphone 40 within the ossicle chain. The structure may be etched into the membranes, deposited onto the membranes or mounted onto the membranes 14*a*, 14*b*.

Figure 21:
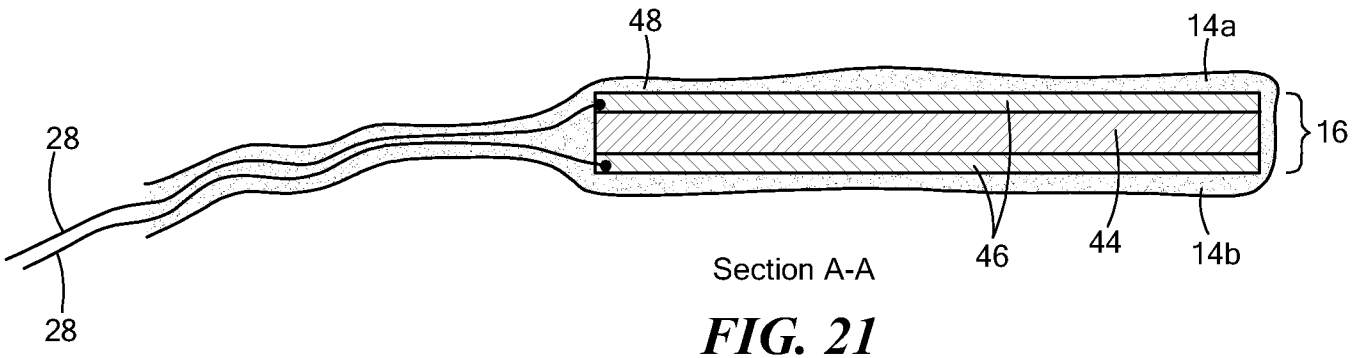
FIG. 21 schematically shows a cross-sectional view of an implantable microphone along lines A-A of FIG. 19 with a flexible film forming the housing.

FIG. 21 schematically shows a cross-sectional view of another embodiment of an implantable microphone 40. In this embodiment, a single or multilayer film 48 surrounds and encapsulates one or more vibration sensors 16, which may include one or more sensor elements 44 and an electrode 46 on either side of the sensor element(s) 44. The film 48 forms a flexible housing 12 that also functions as the membrane 14 adjacent to the one or more vibration sensors 16. For example, as shown in FIG. 21, the film 48 adjacent to the one electrode 46 may function as the first membrane 14*a* and the film 48 adjacent to the other electrode 46 may function as the second membrane 14*b*. The film 48 may be formed from materials such as polymer materials (e.g. Parylene, Epoxy, PMMA, etc.), metal or metal oxides, or a combination thereof or any other combination of materials providing a hermetic, bio resistant and bio compatible coating.

Figure 22:
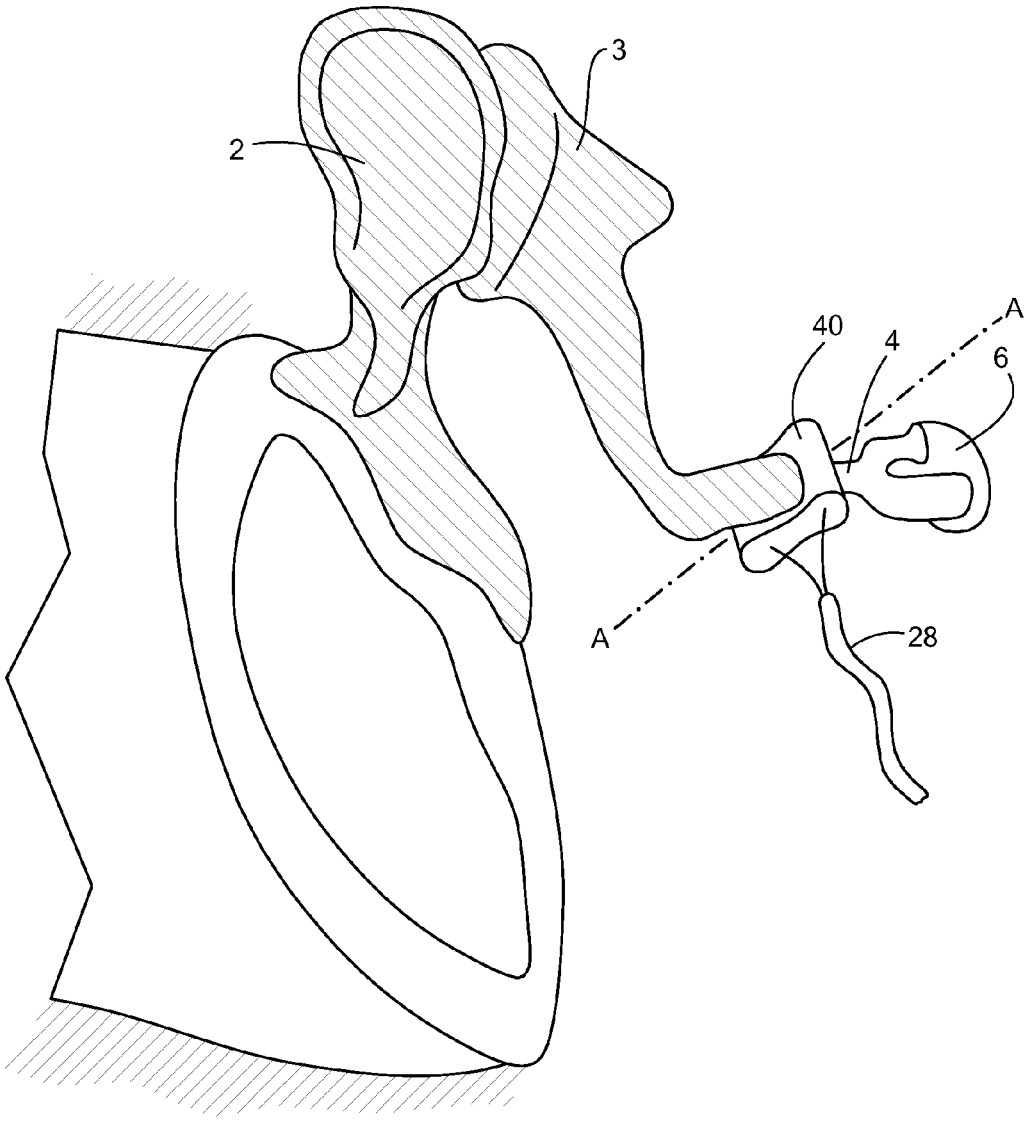
FIG. 22 schematically shows an implantable microphone positioned within the ossicle chain according to another embodiment of the present invention.
Figure 23:
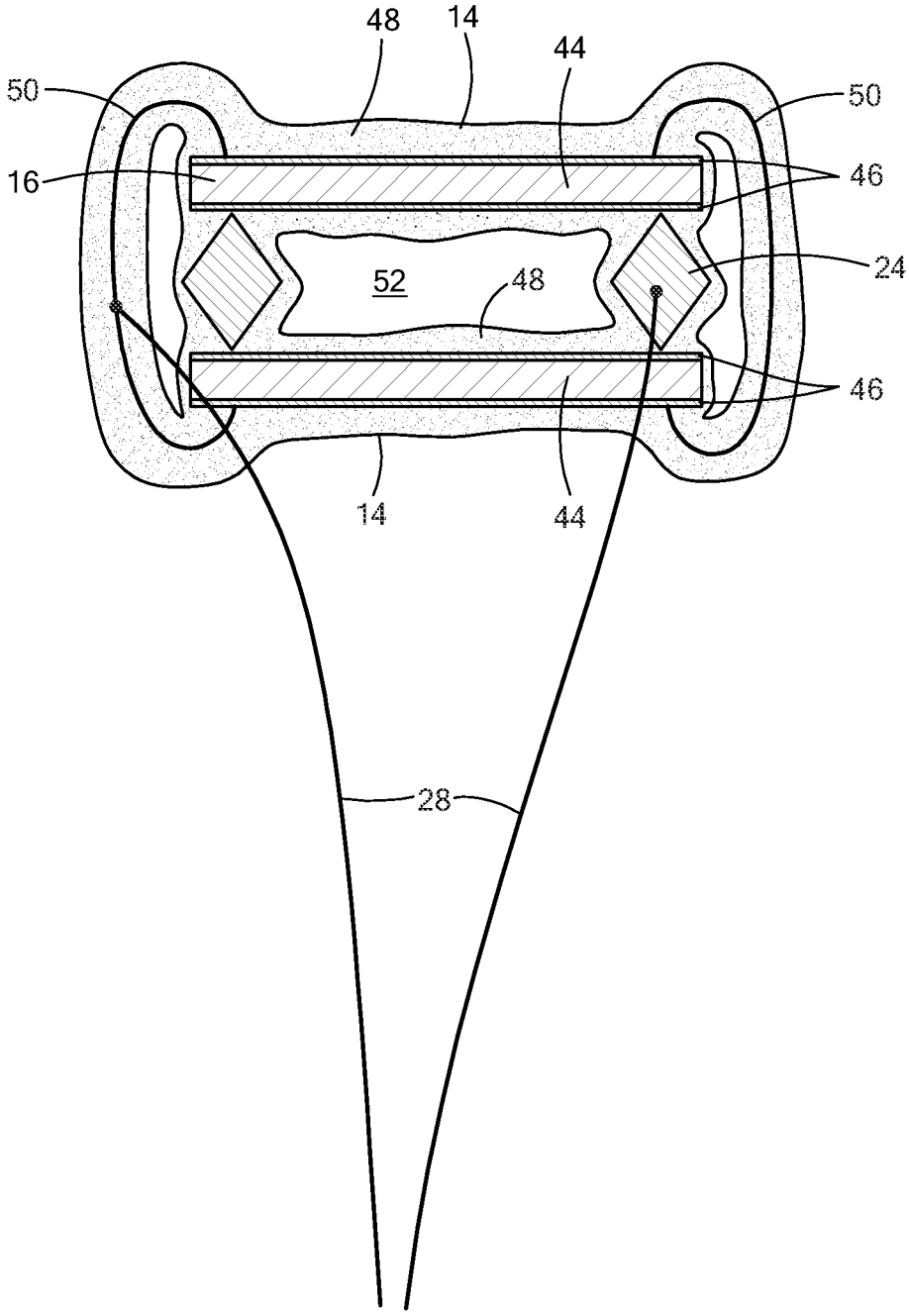
FIG. 23 schematically shows a cross-sectional view of an implantable microphone along lines A-A of FIG. 22 according to embodiments of the present invention.

FIG. 22 schematically shows another embodiment of an implantable microphone 40 positioned within the ossicles chain. As mentioned above, the microphone 40 may be configured to be inserted between two ossicles or between any part of the ossicles, and may include any components or configurations previously described with respect to implantable microphone 10. In this embodiment, the implantable microphone 40 includes a flexible housing 12 formed from a single or multilayer film 48 that surrounds and encapsulates one or more vibration sensors 16, shown as sensor element 44 and electrodes 46 in FIG. 23. As shown in FIG. 23, the film 48 adjacent to one electrode 46 may function as one membrane 14 and the film 48 adjacent to a second electrode 46 may function as the second membrane 14, similar to that described with respect to FIG. 21. As shown in FIG. 23, the microphone 40 may include one or more clamping elements 50 that hold two or more vibration sensors 16 together. The clamping element(s) 50 may be located on one side of the vibration sensors 16 towards their ends (not shown) or on both sides, as shown in FIG. 23. The clamping elements(s) 50 may provide an electrically conductive connection to the outer electrodes 46 of the two or more sensor elements 44. At least one of the clamping elements 50 may provide an electrical contact point to one of the signal leads 28.

The microphone 40 may also include one or more spacing elements, similar to element 24, that may be placed between two or more vibration sensors 16. The spacing element(s) 24 may be configured to keep the vibration sensors 16 separated, but in contact with one another and the portion of the film 48 that forms the membranes 14 so that the vibration sensors 16 move in response to movement from the membranes 14. The spacing elements 24 may provide an electrically conductive connection to the inner electrodes 46 of the two sensor elements 44, such as shown in FIG. 23. At least one of the spacing elements 24 may provide an electrical contact point to another signal lead 28. Embodiments may also include any other electrical interconnection of two or more components of the vibration sensors 16 which provides for an acceptable signal yield (e.g., voltage or charge yield). For example, one or more leads 28 may be electrically coupled to the inner or outer electrodes 46, the clamping element(s) 50 and/or the spacing element(s) 24. The microphone 40 may also include an open area 52 between at least a portion of the two or more vibration sensors 16. The film 48 may be formed adjacent to the one or more vibration sensors 16 and surrounding the open area 52.

Figure 24:
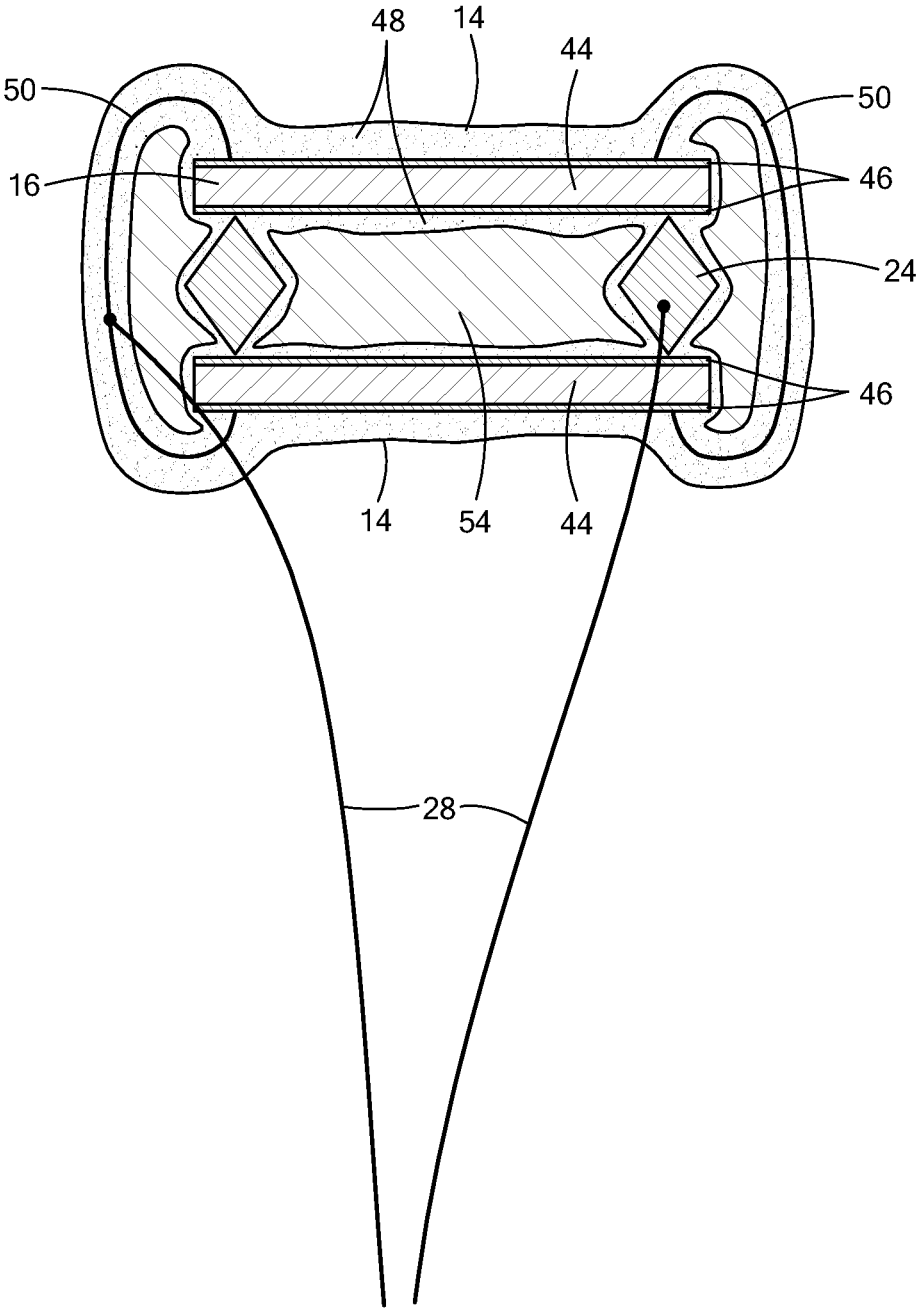
FIG. 24 schematically shows a cross-sectional view of an implantable microphone along lines A-A of FIG. 22 with material within a cavity according to embodiments of the present invention.

Alternatively, as shown in FIG. 24, the open area 52 may be formed between two adjacent vibration sensors 16 (shown as sensor element 44 and electrodes 46 in FIG. 24) without the film 48 surrounding the open area 52. Instead, the open area 52 may include an elastic, viscous or viscoelastic material 54 that is electrically insulating (such as, e.g., silicone, silicone gel, a rubber-like material or any combination thereof). The material 54 may fill or partial fill the space between the vibration sensors 16 and may also be between the clamping elements 50. The film 48 may then surround and encapsulate the whole structure (e.g., the vibration sensors 16, the clamping elements 50, the spacing elements 24, the open area 52 and material 54) with leads 28 extending beyond the encapsulated structure and providing an electrical connection from the vibration sensor(s) 16 to outside of the structure.

The one or more vibration sensors 16 in combination with the film 48 forming the flexible housing 12 may be configured in such a way that the microphone 40 inserted between the ossicles has approximately the same mechanical characteristics (e.g., elasticity) as the cartilage of a joint within the ossicle chain, e.g., the incudo stapedial joint.

As previously mentioned, the microphone 40 may include any components or configurations previously described with respect to implantable microphone 10. For example, FIG. 25 shows a microphone 40 having two membranes 14 and a stack of vibration sensors 16 in a cylindrical housing 12 with each vibration sensor 16 coupled to the sidewall of the housing 12. The microphone 40 may include an spherical shaped spacing element 24 placed between the vibration sensor 16 and the adjacent membrane 14. As before, the element 24 is configured to assist in keeping the vibration sensor 16 in contact with the membrane 14 so that the vibration sensor 16 moves in response to movement from the adjacent membrane 14. In addition, each vibration sensor 16 may include a sensor element 44 and electrodes 46 on either side of the sensor element 44.

Figure 27:
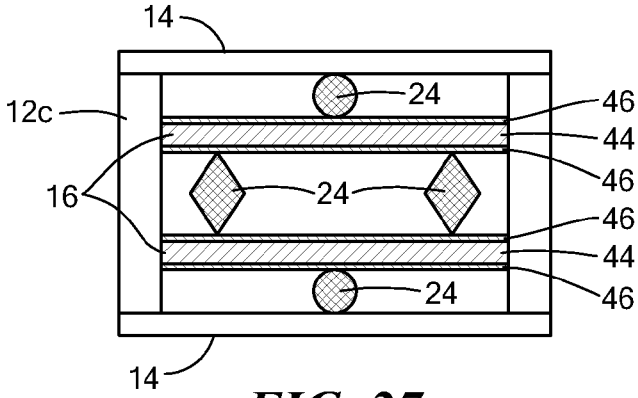
FIG. 27 schematically shows a cross-sectional view of a stack of vibration sensors with two membranes and spacing elements according to embodiments of the present invention.
Figure 28:
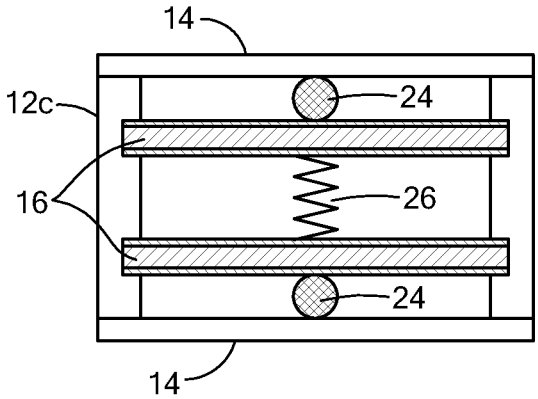
FIG. 28 schematically shows a cross-sectional view of a stack of vibration sensors with two membranes, spacing elements and a spring element according to embodiments of the present invention.
Figure 29:
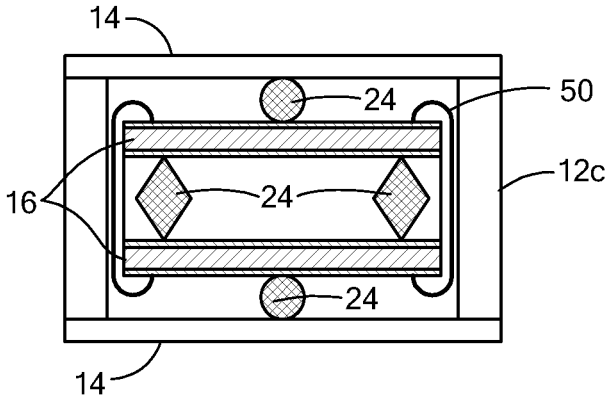
FIG. 29 schematically shows a cross-sectional view of a stack of vibration sensors with two membranes, spacing elements and clamping elements according to embodiments of the present invention.
Figure 30:
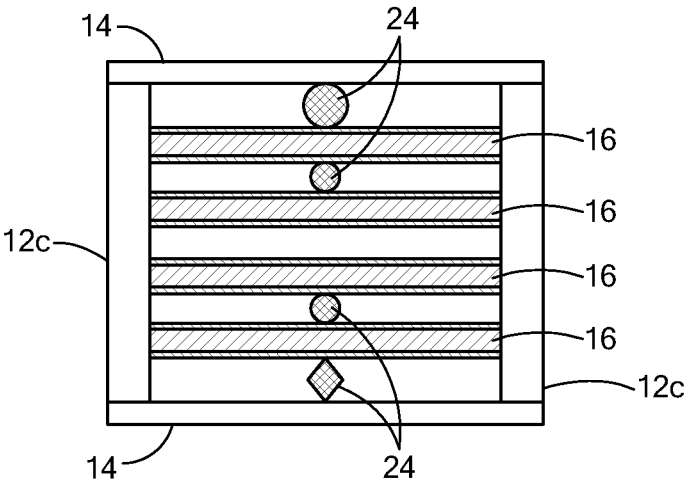
FIG. 30 schematically shows a cross-sectional view of a stack of vibration sensors with two membranes and spacing elements according to embodiments of the present invention.

Similarly, FIGS. 26 through 30 show other possible microphone 40 configurations, although others may be used. FIG. 26 shows a microphone 40 having two membranes 14 and a stack of vibration sensors 16 in a rectangular housing 12 with each vibration sensor 16 coupled to at least one area of the sidewall 12*c* of the housing 12. The microphone 40 may include cylindrical, rod-shaped spacing elements 24 between the vibration sensor 16 and the adjacent membrane 14. FIG. 27 shows a microphone 40 having two membranes 14 and a stack of vibration sensors 16 with a spacing element 24 between the vibration sensor 16 and the adjacent membrane 14 and between the two vibration sensors 16. The elements 24 may be placed anywhere along the length of the vibration sensors 16, e.g., toward the middle or ends of the vibration sensors. FIG. 28 shows a microphone 40 having two membranes 14 and a stack of vibration sensors 16 with a spacing element 24 between the vibration sensor 16 and the adjacent membrane 14 and a spring element 26 between the two vibration sensors 16. FIG. 29 shows a microphone 40 having two membranes 14 and a stack of vibration sensors 16 with a spacing element 24 between the vibration sensor 16 and the adjacent membrane 14 and between the two vibration sensors 16. The microphone 40 may also include one or more clamping elements 50 that hold the two or more vibration sensors 16 together and that may provide an electrically conductive connection to between the two or more vibration sensors 16. FIG. 30 shows a microphone 40 having two membranes 14 and a stack of vibration sensors 16 with spacing elements 24 between the vibration sensor 16 and the adjacent membrane 14 and between two adjacent vibration sensors 16.

Although the above discussion discloses various exemplary embodiments of the invention, it should be apparent that those skilled in the art may make various modifications that will achieve some of the advantages of the invention without departing from the true scope of the invention.

What is claimed is:

1. An implantable microphone for use in hearing systems comprising:

a housing having a back wall and a recess in an exterior surface of the back wall, the recess configured to be coupled to an auditory ossicle;

a membrane coupled to a top portion of the housing, the membrane configured to move in response to movement from the auditory ossicle or a second auditory ossicle and configured to be placed adjacent to the second auditory ossicle, the recess aligned with a center of the membrane; and a vibration sensor adjacent to the membrane, the vibration sensor configured to measure the movement of the membrane and convert the measurement into an electrical signal.

2. The implantable microphone according to claim 1, wherein the vibration sensor is a piezoelectric sensor.

3. The implantable microphone according to claim 2, wherein the piezoelectric sensor is shaped as a rectangular bar.

4. The implantable microphone according to claim 1, wherein the housing has a sidewall between the top portion and the back wall, and the vibration sensor is coupled to the sidewall.

5. The implantable microphone according to claim 4, further comprising a spring element coupled to the vibration sensor, the spring element configured to contact the housing and to assist in keeping the vibration sensor in contact with the membrane.

6. The implantable microphone according to claim 4, further comprising one or more additional vibration sensors adjacent to the vibration sensor, the one or more additional vibration sensors coupled to the sidewall.

7. The implantable microphone according to claim 6, further comprising a spring element coupled to the one or more additional vibration sensors, the spring element configured to contact the housing and to assist in keeping the one or more vibration sensors in contact with each other and the membrane.

8. The implantable microphone according to claim 4, further comprising an element positioned between the vibration sensor and the membrane, the element configured to move the vibration sensor in response to movement from the membrane.

9. The implantable microphone according to claim 1, wherein the back wall further includes a channel extending from the recess to at least one area of the sidewall of the housing.

10. The implantable microphone according to claim 9, wherein the recess is further recessed than the channel.

11. The implantable microphone according to claim 1, wherein the vibration sensor includes a stack of vibration sensors.

12. The implantable microphone according to claim 1, wherein the vibration sensor is coupled to the membrane.

13. The implantable microphone according to claim 1, wherein the membrane further includes a structure positioned at a center of the membrane.

14. The implantable microphone according to claim 1, further comprising one or more prostheses coupled to the housing.

15. An implantable microphone configured to be coupled to an auditory ossicle comprising:

a housing having a top portion, a back wall, a sidewall between the top portion and the back wall, and a recess in an exterior surface of the back wall, the recess configured to be coupled to the auditory ossicle;

a membrane coupled to the top portion of the housing, the membrane configured to move in response to movement from the auditory ossicle or a second auditory ossicle and configured to be placed adjacent to the second auditory ossicle, the recess aligned with a center of the membrane; and a vibration sensor coupled to the sidewall and adjacent to the membrane, the vibration sensor configured to measure the movement of the membrane and to convert the measurement into an electrical signal.

16. The implantable microphone according to claim 15, wherein the back wall further includes a channel extending from the recess to at least one area of the sidewall of the housing.

17. The implantable microphone according to claim 16, wherein the recess is further recessed than the channel.

18. The implantable microphone according to claim 15, wherein the vibration sensor is a piezoelectric sensor.

19. The implantable microphone according to claim 18, wherein the piezoelectric sensor is shaped as a rectangular bar.

20. The implantable microphone according to claim 15, further comprising a spring element coupled to the vibration sensor, the spring element configured to contact the housing and to assist in keeping the vibration sensor in contact with the membrane.

21. The implantable microphone according to claim 15, further comprising one or more additional vibration sensors adjacent to the vibration sensor, the one or more additional vibration sensors coupled to the sidewall.

22. The implantable microphone according to claim 15, further comprising an element positioned between the vibration sensor and the membrane, the element configured to move the vibration sensor in response to movement from the membrane.

23. The implantable microphone according to claim 15, wherein the vibration sensor includes a stack of vibration sensors.

24. The implantable microphone according to claim 15, wherein the membrane further includes a structure positioned at a center of the membrane.

* * * * *